US012624301B2

(12) United States Patent
Choi et al.

(10) Patent No.: US 12,624,301 B2
(45) Date of Patent: May 12, 2026

(54) PROCESSES FOR UPGRADING HYDROCARBON FEEDSTOCK

(71) Applicant: Saudi Arabian Oil Company, Dhahran (SA)

(72) Inventors: Ki-Hyouk Choi, Dhahran (SA); Young-Kyoung Ahn, Dhahran (SA); Mamdouh Abdoun Al-Harbi, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 172 days.

(21) Appl. No.: 18/439,417

(22) Filed: Feb. 12, 2024

(65) Prior Publication Data

US 2025/0257271 A1 Aug. 14, 2025

(51) Int. Cl.
*C10G 65/12* (2006.01)

(52) U.S. Cl.
CPC ..... *C10G 65/12* (2013.01); *C10G 2300/1074* (2013.01); *C10G 2300/4006* (2013.01); *C10G 2300/4012* (2013.01); *C10G 2300/4018* (2013.01); *C10G 2400/30* (2013.01)

(58) Field of Classification Search
CPC ..... C10G 69/06; C10G 65/12; C10G 2300/4006; C10G 2300/1074; C10G 2300/4012; C10G 2300/4018; C10G 2400/30
See application file for complete search history.

(56) References Cited

U.S. PATENT DOCUMENTS

| | | | | |
|---|---|---|---|---|
| 3,619,407 | A | 11/1971 | Hendricks et al. | |
| 4,792,390 | A | 12/1988 | Staggs et al. | |
| 4,814,064 | A | 3/1989 | Staggs et al. | |
| 9,145,523 | B2 | 9/2015 | Choi et al. | |
| 10,011,786 | B1 * | 7/2018 | Eizenga | B01D 15/1871 |
| 10,301,560 | B2 | 5/2019 | Wang et al. | |

(Continued)

FOREIGN PATENT DOCUMENTS

CN 101724449 A 6/2010

OTHER PUBLICATIONS

Notification of Transmittal of the International Search Report and the Written Opinion of the International Searching Authority, or the Declaration dated Jan. 27, 2025 pertaining to International application No. PCT/US2024/052324 filed Oct. 22, 2024, pp. 1-13.

*Primary Examiner* — Prem C Singh
*Assistant Examiner* — Brandi M Doyle
(74) *Attorney, Agent, or Firm* — DINSMORE & SHOHL LLP

(57) ABSTRACT

A process for upgrading a hydrocarbon feedstock may include introducing a hydrocarbon feedstock into a hydrocracking unit to obtain a hydrocracked product, introducing the hydrocracked product to a fractionation unit to obtain distillates and unconverted oil, the unconverted oil having a boiling point greater than 375° C., introducing the unconverted oil and supercritical water to a supercritical water unit to obtain a treated product, wherein the supercritical water has a pressure greater than 21 MPa and a temperature above 374° C., and separating the treated product to obtain a purified product and a concentrated product, wherein the concentrated product includes heavy polynuclear aromatics (HPNA).

18 Claims, 3 Drawing Sheets

(56) References Cited

U.S. PATENT DOCUMENTS

| | | | | |
|---|---|---|---|---|
| 10,920,157 | B2 | 2/2021 | Koseoglu | |
| 10,975,317 | B2 * | 4/2021 | Choi | C10G 9/36 |
| 11,021,659 | B2 | 6/2021 | Choi et al. | |
| 2019/0316045 | A1 * | 10/2019 | Choi | C10G 7/06 |
| 2021/0198586 | A1 | 7/2021 | Koseoglu | |

* cited by examiner

PROCESSES FOR UPGRADING HYDROCARBON FEEDSTOCK

TECHNICAL FIELD

Embodiments described herein generally relate processes for upgrading hydrocarbon feedstock.

BACKGROUND

Hydrocracking processes crack large hydrocarbon compounds into smaller hydrocarbon compounds with aid of a catalyst and hydrogen to produce products that can be used in fuels and chemical feedstocks.

Hydrocracking catalysts typically suffer from coking, which shortens the catalyst life. Coke precursors, present in feed materials or formed in the reactor, undergoes coupling, condensation, cyclization, aromatization, and dehydrogenation to form coke materials on catalyst. Coke is formed from strongly adsorbed aromatic compounds on the catalyst surface and subsequent condensation reactions. Severity of the process conditions may be increased to compensate for the reduced catalyst activity caused by coking. However, greater severity of the process accelerates coke formation and eventually catalyst deactivation.

In general, typical hydrocarbon feedstocks used for hydrocracking, such as vacuum gas oil (VGO), contain 2-6 ring polynuclear aromatics. Through coupling or condensation reactions that occur at the high temperatures typically used for hydrocracking, the ring size may increase to form heavy polynuclear aromatics. Heavy polynuclear aromatics contain 7+ aromatic rings, are uncharged, non-polar, and planar in structure, and are highly effective coke precursors. Heavy polynuclear aromatics are produced by coupling or condensation of smaller polynuclear aromatics and single ring aromatics during the hydrocracking reaction. Heavy polynuclear aromatics are inert under conventional hydrocracking conditions, so the heavy polynuclear aromatics are not typically decomposed or hydrogenated. Therefore, improved methods of upgrading hydrocarbon feedstocks that address catalyst deactivation caused by heavy polynuclear aromatics are needed.

SUMMARY

Embodiments of the present disclosure meet this and other needs by utilizing supercritical water processing to reduce heavy polynuclear aromatics in upgraded hydrocarbons. The process may include introducing a hydrocarbon feedstock into a hydrocracking unit to obtain a hydrocracked product, introducing the hydrocracked product to a fractionation unit to obtain distillates and unconverted oil, the unconverted oil having a boiling point greater than 375° C., introducing the unconverted oil and supercritical water to a supercritical water unit (SCW) to obtain a treated product, wherein the supercritical water has a pressure greater than 21 MPa and a temperature above 374° C., and separating the treated product to obtain a purified product and a concentrated product, wherein the concentrated product includes heavy polynuclear aromatics (HPNA).

It is to be understood that both the preceding general description and the following detailed description describe various embodiments and are intended to provide an overview or framework for understanding the nature and character of the claimed subject matter. Additional features and advantages of the embodiments will be set forth in the detailed description and, in part, will be readily apparent to persons of ordinary skill in the art from that description, which includes the accompanying drawings and claims, or recognized by practicing the described embodiments. The drawings are included to provide a further understanding of the embodiments and, together with the detailed description, serve to explain the principles and operations of the claimed subject matter. However, the embodiments depicted in the drawings are illustrative and exemplary in nature, and not intended to limit the claimed subject matter.

BRIEF DESCRIPTION OF DRAWINGS

The following detailed description may be better understood when read in conjunction with the following drawings, in which.

DETAILED DESCRIPTION

Figure 1:
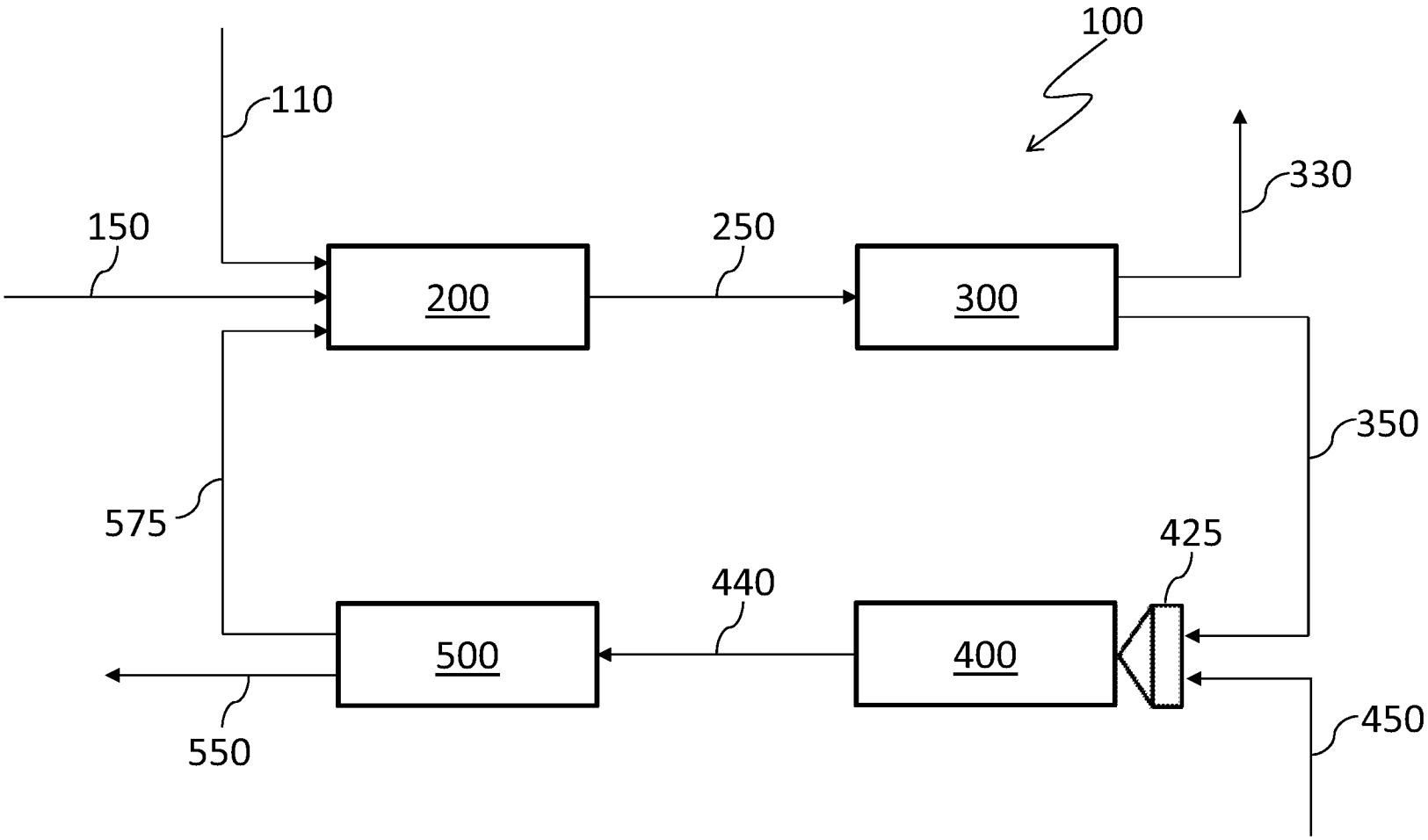
FIG. 1 illustrates a schematic view of an example system for upgrading a hydrocarbon feedstock that may be suitable for use with the processes for upgrading hydrocarbon feedstock.

The present disclosure is generally directed to a process for upgrading hydrocarbon feedstock. The process may generally include introducing a hydrocarbon feedstock into a hydrocracking unit to obtain a hydrocracked product, introducing the hydrocracked product to a fractionation unit to obtain distillates and unconverted oil, the unconverted oil having a boiling point greater than 375° C., introducing the unconverted oil and supercritical water to a supercritical water unit to obtain a treated product, wherein the supercritical water has a pressure greater than 21 MPa and a temperature above 374° C., and separating the treated product to obtain a purified product and heavy polynuclear aromatics.

As used in this disclosure, a "catalyst" refers to any inorganic substances other than water that increases the rate of a specific chemical reaction.

As used in this disclosure, "cracking" generally refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

As used throughout this disclosure, "crude oil" refers to whole range crude oil, distilled crude oil, residue oil, topped crude oil, product streams from oil refineries, product streams from steam cracking processes, liquefied coals, liquid products recovered from oil or tar sands, bitumen, oil shale, asphaltene, biomass hydrocarbons, liquid product from Gas-to-Liquid (GTL) process, liquid product from chemical recycling of waste plastic/municipal waste, and other similar petroleum-based oils.

As used in this disclosure, "hydrocracking" refers to cracking that occurs in the presences of hydrogen, such as hydrogen in the form of hydrogen gas or a hydrogen donor.

As used throughout this disclosure, "standard ambient temperature and pressure" or "SATP" refers to conditions of 25° C. and 100 kPa of pressure.

As used throughout the disclosure, "supercritical" refers to a substance at a pressure and a temperature greater than that of its critical pressure and temperature, such that distinct phases do not exist and the substance may exhibit the diffusion of a gas while dissolving materials like a liquid.

As used throughout this disclosure, "supercritical water" or "SCW" refers to water that is at a temperature above the critical temperature of water and a pressure above the critical pressure of water.

As used through this disclosure "unconverted oil" or "UCO" refers to a fraction of hydrocracked product that has a boiling point of greater than 375° C.

As used throughout this disclosure, the terms "upgrade," "upgraded," or "upgrading" refer to the process of at least partially converting at least some less valuable petroleum-based material into at least some greater value chemical products and intermediates. As a non-limiting example, at least some of a crude oil might be upgraded to produce at least some ethylene, propene, and butene.

Now referring to FIG. 1, an exemplary system 100 that may be used with the process for upgrading a hydrocarbon feedstock disclosed and described herein is schematically depicted. The process generally includes introducing a hydrocarbon feedstock 150 into a hydrocracking unit 200 to obtain a hydrocracked product 250, introducing the hydrocracked product 250 to a fractionation unit 300 to obtain distillates 330 and unconverted oil 350, the unconverted oil 350 having a boiling point greater than 375° C., introducing the unconverted oil 350 and supercritical water 450 to a supercritical water unit 400 to obtain a treated product 440, wherein the supercritical water 450 has a pressure greater than 21 MPa and a temperature above 374° C., and separating the treated product 440 to obtain a purified product 575 and a concentrated product 550. The concentrated product 550 includes heavy polynuclear aromatics (HPNA).

In some embodiments, the hydrocarbon feedstock 150 may include a raw hydrocarbon material which has not been previously treated, separated, or otherwise refined (such as crude oil). In some embodiments, the hydrocarbon feedstock 150 may include a hydrocarbon material which has undergone some degree of processing, such as treatment, separation, reaction, purifying, or other operation. In various embodiments, the hydrocarbon feedstock 150 may include whole range crude oil, or fractions of crude oil such as atmospheric residue, vacuum gas oil, and vacuum residue, and combinations thereof. In one or more embodiments, the hydrocarbon feedstock 150 may include vacuum gas oil having a boiling range of from 300 to 600° C. In one or more embodiments, the hydrocarbon feedstock 150 may include pyrolysis fuel oil from a steam cracker. In one or more embodiments, the hydrocarbon feedstock 150 may include liquid hydrocarbons from plastic liquefaction, biomass liquefaction, coal liquefaction, or combinations thereof. In one or more embodiments, the hydrocarbon feedstock 150 may include deasphalted oil.

In some embodiments, the hydrocarbon feedstock 150 may have a heavy polynuclear aromatic concentration of from 0 to 800 parts per million by weight (ppmw). In some embodiments, the hydrocarbon feedstock 150 may have a heavy polynuclear aromatic concentration of from 0 to 800 ppmw, from 0 to 775 ppmw, from 0 to 750 ppmw, from 0 to 725 ppmw, from 0 to 700 ppmw, from 0 to 650 ppmw, from 0 to 600 ppmw, from 0 to 500 ppmw, from 0 to 250 ppmw, from 0 to 100 ppmw, 100 to 800 ppmw, from 100 to 775 ppmw, from 100 to 750 ppmw, from 100 to 725 ppmw, from 100 to 700 ppmw, from 100 to 650 ppmw, from 100 to 600 ppmw, from 100 to 500 ppmw, from 100 to 250 ppmw, from 250 to 800 ppmw, from 250 to 775 ppmw, from 250 to 750 ppmw, from 250 to 725 ppmw, from 250 to 700 ppmw, from 250 to 650 ppmw, from 250 to 600 ppmw, from 250 to 500 ppmw, 500 to 800 ppmw, from 500 to 775 ppmw, from 500 to 750 ppmw, from 500 to 725 ppmw, from 500 to 700 ppmw, from 500 to 650 ppmw, or from 500 to 600 ppmw.

In some embodiments, the hydrocarbon feedstock 150 may have a heavy polynuclear aromatic concentration as high as 800 ppmw. Such a high concentration of heavy polynuclear aromatics is not acceptable for conventional hydrocracking processes, as it leads to severe catalyst coking under the harsh process conditions (hydrogen pressure from 6 to 25 MPa and temperatures from 350 to 450° C., with low space velocities from 0.05 to 1 $hr^{-1}$ in the hydrocracking unit) required for high conversion rates. However, the present process allows for the use of milder process conditions with comparable overall conversion rates, because the supercritical water treatment aids also produces converted product.

In various embodiments, the hydrocracking unit 200 may include a fixed-bed reactor, a moving bed reactor, an ebullated-bed reactor, or a slurry-bed type reactor. In some embodiments, the hydrocracking unit 200 may include a single stage reactor or a multi-stage reactor. In one or more embodiments, the hydrocracking unit 200 may be operated at a temperature of from 300 to 500° C., from 300 to 475° C., from 300 to 450° C., from 315 to 500° C., from 315 to 475° C., or from 315 to 450° C. In one or more embodiments, the hydrocracking unit 200 may be operated at a pressure of from 5 to 25 MPa, such as from 5.5 to 25 MPa, from 6 to 25 MPa, from 5 to 24 MPa, from 5.5 to 24 MPa, from 6 to 24 MPa, from 5 to 23 MPa, from 5.5 to 23 MPa, from 6 to 23 MPa, from 5 to 22 MPa, from 5.5 to 22 MPa, from 6 to 22 MPa, from 5 to 21 MPa, from 5.5 to 21 MPa, from 6 to 21 MPa, from 5 to 20 MPa, from 5.5 to 20 MPa, or from 6 to 20 MPa.

In one or more embodiments, the hydrocarbon feedstock 150 may have a liquid hourly space velocity (LHSV) in the hydrocracking unit 200 of from 0.05 to 3 per hour ($hr^{-1}$), such as from 0.1 to 3 $hr^{-1}$, from 0.5 to 3 $hr^{-1}$, from 1 to 3 $hr^{-1}$, from 2 to 3 $hr^{-1}$, $^{0.05}$ to 2 per hour ($hr^{-1}$), such as from 0.1 to 2 $hr^{-1}$, from 0.5 to 2 $hr^{-1}$, from 1 to 2 $hr^{-1}$, $^{0.05}$ to 1 per hour ($hr^{-1}$), such as from 0.1 to 1 $hr^{-1}$, from 0.5 to 1 $hr^{-1}$, 0.05 to 0.5 $hr^{-1}$, from 0.1 to 0.5 $hr^{-1}$, or from 0.05 to 0.1 $hr^{-1}$.

In various embodiments, the hydrocracking unit 200 may include a catalyst. In some embodiments, the catalyst may include an active metal compound on an acidic support. In one or more embodiments, the active metal may be nickel (Ni), cobalt (Co), molybdenum (Mo), or tungsten (W) containing sulfide. In one or more embodiments, the acidic support may be zeolite, amorphous silica-alumina, alumina, or a composite thereof. In some embodiments, the catalyst may include a promoter, such as a transition metal, a rare earth metal, an alkali metal, an alkaline earth metal, or combinations thereof.

The hydrogen feed 110 may be introduced into the hydrocracking unit 200 at a pressure of from 5 to 25 MPa, such as from 5.5 to 25 MPa, from 6 to 25 MPa, from 5 to 24 MPa, from 5.5 to 24 MPa, from 6 to 24 MPa, from 5 to 23 MPa, from 5.5 to 23 MPa, from 6 to 23 MPa, from 5 to 22 MPa, from 5.5 to 22 MPa, from 6 to 22 MPa, from 5 to 21 MPa, from 5.5 to 21 MPa, from 6 to 21 MPa, from 5 to 20 MPa, from 5.5 to 20 MPa, or from 6 to 20 MPa. In some embodiments, the hydrogen feed may have a flow rate of from 300 to 3000 cubic meters ($m^3$) per cubic meter of hydrocarbon feedstock, such as from 350 to 3000 $m^3$, 400 to 3000 $m^3$, 450 to 3000 $m^3$, 500 to 3000 $m^3$, from 300 to 2500 $m^3$, from 350 to 2500 $m^3$, 400 to 2500 $m^3$, 450 to 2500 $m^3$, 500 to 2500 $m^3$, from 300 to 2000 $m^3$, from 350 to 2000 $m^3$, 400 to 2000 $m^3$, 450 to 2000 $m^3$, 500 to 2000 $m^3$, from 350 to 1500 $m^3$, 400 to 1500 $m^3$, 450 to 1500 $m^3$, 500 to 1500 $m^3$, per cubic meter of hydrocarbon feedstock.

In various embodiments, the hydrocracking unit 200 may be operated to achieve at least 50% conversion such as from 50 to 100%, wherein conversion is determined according to Equation (1).

Equation (1)

$$\text{Conversion} = 100\% - \left(\frac{\text{Unconverted Oil Weight}}{\text{Total Hydrocarbon Feedstock Weight}} \times 100\right)$$

In some embodiments, the hydrocracked product 250 may include less than or equal to 50 weight percent (wt. %) unconverted oil, such as from 0 to 50 wt. % unconverted oil.

As stated hereinabove, the process includes introducing the hydrocracked product 250 to a fractionation unit 300 to obtain distillates 330 and unconverted oil 350. In some embodiments, the fractionation unit 300 may be a single or multistage gas-liquid separator and a distillation tower. In one or more embodiments, the fractionation unit 300 may separate the distillates into liquefied petroleum gas, naphtha, and gas oil.

In various embodiments, the UCO may have a sulfur content of less than 100 ppmw, such as from 0 to 100 ppmw, from 0 to 75 ppmw, from 0 to 50 ppmw, or from 0 to 25 ppmw sulfur. In some embodiments, the UCO may have a nitrogen content of less than 10 ppmw, such as 0 to 10 ppmw, 0 to 8 ppmw, 0 to 5 ppmw, or 0 to 2 ppmw nitrogen. In various embodiments, the UCO may have a metal content of less than 10 ppmw, such as 0 to 10 ppmw, 0 to 8 ppmw, 0 to 5 ppmw, or 0 to 2 ppmw metal.

In some embodiments, the supercritical water 450 may be demineralized water. In one or more embodiments, the supercritical water 450 may have a salinity defined by a conductivity of less than 1 microsiemens (μS)/centimeters (cm). In one or more embodiments, the supercritical water 450 may have a salinity of less than 1 μS/cm, 0.75 μS/cm, 0.5 μS/cm, 0.25 μS/cm, 0.1 μS/cm, 0.075 μS/cm, 0.065 μS/cm, 0.060 μS/cm, 0.0575 μS/cm, or 0.055 μS/cm, 0.050 μS/cm. In one or more embodiments, the feed water may comprise a sodium content less than or equal to 5 micrograms per liter (μg/L). In one or more embodiments, the feed water may comprise a sodium content less than or equal to 5 μg/L, 4 μg/L, 3 μg/L, 2 μg/L, or 1 μg/L. In one or more embodiments, the feed water may comprise a chloride content of less than or equal to 5 μg/L. In one or more embodiments, the feed water may comprise a chloride content of less than or equal to 5 μg/L, 4 μg/L, 3 μg/L, 2 μg/L, or 1 μg/L. In one or more embodiments, the feed water may comprise a silica content of less than or equal to 3 μg/L. In one or more embodiments, the feed water may comprise a silica content of less than or equal to 3 μg/L, 2 μg/L, 1 μg/L, 0.5 μg/L, or 0.25 μg/L.

Figure 2:
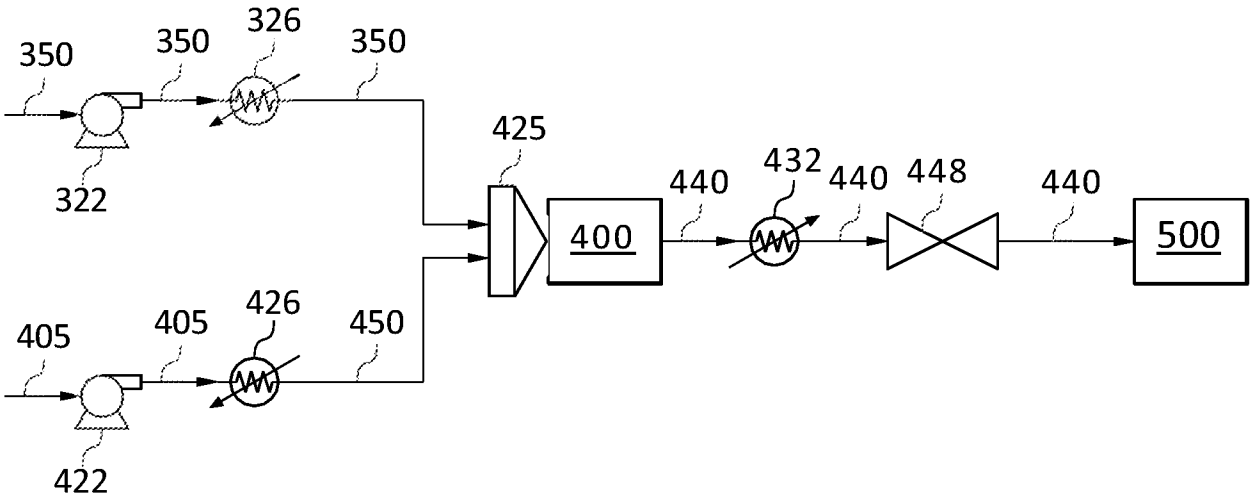
FIG. 2 illustrates a schematic view of an example setup of the SCW unit.

Referring now to FIG. 2, in various embodiments, the unconverted oil 350 and the supercritical water 450 are passed to the supercritical water unit 400 by separated pumps. In one or more embodiments, the pumps may be metering pumps, plunger pumps, or combinations thereof.

In one or more embodiments, the supercritical water 450 has a pressure over 21 MPa and a temperature of greater than or equal to 374° C. In one or more embodiments, a water feed 405 may be pressurized by a pump 422 and may be heated by one or more heaters 426 to create supercritical water 450. In one or more embodiments, the heaters may be fired furnaces, electric heaters, heat exchangers, other similar heaters, or combinations thereof. In one or more embodiments, the pump may compress the water feed 405 to achieve a pressure of from 21 to 35 MPa, from 22 to 35 MPa, from 23 to 35 MPa, from 25 to 35 MPa, from 30 to 35 MPa, from 21 to 30 MPa, from 22 to 30 MPa, from 23 to 30 MPa, from 25 to 30 MPa, from 21 to 25 MPa, from 22 to 25 MPa, or from 23 to 25 MPa. In one or more embodiments, the water feed 405 may be heated to a temperature of from 374 to 700° C., 400 to 700° C., 425 to 600° C., 450 to 700° C., 500 to 700° C., 550 to 700° C., 374 to 600° C., 400 to 600° C., 425 to 600° C., 450 to 600° C., 500 to 600° C., 550 to 600° C., 374 to 550° C., 400 to 550° C., 425 to 550° C., 450 to 550° C., 500 to 550° C., 374 to 500° C., 400 to 500° C., 425 to 500° C., 450 to 500° C., 374 to 450° C., 400 to 450° C., 425 to 450° C., 374 to 425° C., 400 to 425° C., or 374 to 400° C.

In one or more embodiments, the unconverted oil 350 may be pressurized to a pressure over 21 MPa. In one or more embodiments, the unconverted oil 350 may be pressurized by a pump 322. In one or more embodiments, the pump may compress the unconverted oil 350 to a pressure of from 21 to 35 MPa, from 22 to 35 MPa, from 23 to 35 MPa, from 25 to 35 MPa, from 30 to 35 MPa, from 21 to 30 MPa, from 22 to 30 MPa, from 23 to 30 MPa, from 25 to 30 MPa, from 21 to 25 MPa, from 22 to 25 MPa, or from 23 to 25 MPa.

In some embodiments, the unconverted oil 350 may be heated to a temperature of greater than or equal to 50° C. and less than or equal to 350° C. In one or more embodiments, the unconverted oil 350 may be heated by one or more heaters 326. In one or more embodiments, the heaters may be fired furnaces, electric heaters, heat exchangers, other similar heaters, or combinations thereof. In one or more embodiments, the unconverted oil may be heated to a temperature between 50 to 350° C., 75 to 350° C., 100 to 350° C., 150 to 350° C., 200 to 350° C., 250 to 350° C., 300 to 350° C., 50 to 300° C., 75 to 300° C., 100 to 300° C., 150 to 300° C., 200 to 300° C., 250 to 300° C., 50 to 250° C., 75 to 250° C., 100 to 250° C., 150 to 250° C., 200 to 250° C., 50 to 200° C., 75 to 200° C., 100 to 200° C., 150 to 200° C., 50 to 150° C., 75 to 150° C., 100 to 150° C., 50 to 100° C., 75 to 100° C., 50 to 75° C., or combinations thereof.

In one or more embodiments, the supercritical water 450 and the unconverted oil 350 may have flow rates defined by a flow rate ratio of from 20:1 to 1:1 at standard ambient temperature and pressure (SATP). In one or more embodiments, the supercritical water 450 and the unconverted oil 350 may have a flow rate of from 20:1 to 1:1, 20:1 to 2:1, 20:1 to 3:1, 20:1 to 4:1, 20:1 to 5:1, 20:1 to 6:1, 20:1 to 7:1, 20:1 to 8:1, 20:1 to 9:1, 20:1 to 10:1, 10:1 to 1:1, 10:1 to 2:1, 10:1 to 3:1, 10:1 to 4:1, 10:1 to 5:1, 10:1 to 6:1, 10:1 to 7:1, 10:1 to 8:1, 10:1 to 9:1, 9:1 to 1:1, 9:1 to 2:1, 9:1 to 3:1, 9:1 to 4:1, 9:1 to 5:1, 9:1 to 6:1, 9:1 to 7:1, 9:1 to 8:1, 8:1 to 1:1, 8:1 to 2:1, 8:1 to 3:1, 8:1 to 4:1, 8:1 to 5:1, 8:1 to 6:1, 8:1 to 7:1, 7:1 to 1:1, 7:1 to 2:1, 7:1 to 3:1, 7:1 to 4:1, 7:1 to 5:1, 7:1 to 6:1, 6:1 to 1:1, 6:1 to 2:1, 6:1 to 3:1, 6:1 to 4:1, 6:1 to 5:1, 5:1 to 1:1, 5:1 to 2:1, 5:1 to 3:1, 5:1 to 4:1, 4:1 to 1:1, 4:1 to 2:1, 4:1 to 3:1, 3:1 to 1:1, 3:1 to 2:1, or 2:1 to 1:1 at SATP.

In various embodiments, supercritical water 450 and heated unconverted oil 350 may be combined with a mixer 425 before being introduced to the supercritical water unit 400. The mixer 425 may be an in-line mixer, a tee fitting, a static mixer, a stirred mixer, or other similar mixer. In some embodiments, the supercritical water unit 400 may be a tubular reactor, pipe reactor, a continuous stirred-tank reactor (CSTR), or a combined reactor.

Without being bound by theory supercritical water is believed to dissolve organic compounds due to its low dielectric constant. However, solubility of organic compounds depends on their structure and molecular weight. In general, larger molecules are difficult to quickly dissolve in supercritical water. Particularly, polynuclear aromatics, including HPNA tends to form aggregates in SCW environments due to strong interaction between polynuclear aromatics that are caused by van der Waals force. Larger HPNA have stronger tendency to form aggregates in SCW than smaller polynuclear aromatics. Molecules other than polynuclear aromatics may impact the size of the HPNA aggregates formed. Small aromatic compounds such as toluene can improve solubility of polynuclear aromatics and thus eventually reduce the size of aggregates. In contrast, paraffinic molecules reduces the solubility of polynuclear aromatics in SCW. Polynuclear aromatics and HPNA are not decomposed under SCW conditions, although they may be gasified if the SCW has a temperature of greater than or equal to 800° C.

In SCW, large paraffinic molecules can be cracked to form smaller paraffins and olefins. Aromatic compounds can be formed through cyclization, aromatization, and dehydrogenation of paraffins and olefins. However, the aromatic compound formation under SCW conditions is regarded as a secondary reaction. Due to the short residence time (60 minutes or less) of the UCO in the SCW unit, aromatic formation is not expected to be significant. Thus, it can be presumed that SCW reactor is filled with paraffins and olefins as well as small amount of aromatics and HPNA.

UCO is regarded as a highly saturated material (>95 wt % saturated compounds), meaning that most of the molecules in it are paraffinic. The paraffins in UCO are readily dissolved in SCW and cracked to produce paraffins and olefins. Original paraffins and newly formed paraffins/olefins deter dissolution of HPNA and induce phase segregation of HPNA. The segregated phase has much higher concentration of HPNA and lower concentration of SCW. Thus, the HPNA undergo radical-induced condensation reactions to create larger HPNA molecules In one or more embodiments, the combined supercritical water 450 and unconverted oil 350 may have a residence time in the supercritical water unit 400 of greater than or equal to 10 seconds, and less than or equal to 60 minutes. In one or more embodiments, the combined supercritical water 450 and unconverted oil 350 may have a residence time in the supercritical water unit 400 of from 10 seconds to 60 minutes, from 30 seconds to 60 minutes, from 1 minute to 60 minutes, from 5 minutes to 60 minutes, from 10 minutes to 60 minutes, from 15 minutes to 60 minutes, from 20 minutes to 60 minutes, from 30 minutes to 60 minutes, from 10 seconds to 45 minutes, from 30 seconds to 45 minutes, from 1 minute to 45 minutes, from 5 minutes to 45 minutes, from 10 minutes to 45 minutes, from 15 minutes to 45 minutes, from 20 minutes to 45 minutes, from 30 minutes to 45 minutes, from 10 seconds to 30 minutes, from 30 seconds to 30 minutes, from 1 minute to 30 minutes, from 5 minutes to 30 minutes, from 10 minutes to 30 minutes, from 15 minutes to 30 minutes, or from 20 minutes to 30 minutes. The residence time may be calculated by assuming the density of the fluid in the reactor has the density of water at reaction conditions.

In one or more embodiments, the combined supercritical water 450 and unconverted oil 350 may be in a turbulent flow regime with a Reynolds number greater than or equal to 3000. For example, the combined supercritical water 450 and unconverted oil 350 may be in a turbulent flow regime with a Reynolds number greater than or equal to 3000, 4000, 5000, 6000, 7000, 8000, 9000, 10,000, 11,000, 12,000, 13,000, 14,000, 15,000, 16,000, 17,000, 18,000, 19,000, 20,000, 25,000, 50,000, 75,000, or 100,000. The Reynolds number may be calculated by assuming the density of the fluid in the reactor has the density of water at reaction condition.

In one or more embodiments, the volume of the supercritical water unit 400 may be selected by determining the desired residence time of the combined supercritical water 450 and unconverted oil 350 supercritical water unit 400 (assuming the internal fluid is 100% water). In one or more embodiments, the supercritical water unit 400 may be arranged to be horizontal, vertical, inclined, declined, or combined.

In one or more embodiments, the supercritical water unit 400 may be operated at a temperature of greater than or equal to 374° C. In one or more embodiments, the supercritical water unit 400 may be operated at a temperature of from 374 to 600° C., 380 to 600° C., 390 to 600° C., 400 to 600° C., 425 to 600° C., 450 to 600° C., 460 to 600° C., 475 to 600° C., 500 to 600° C., 550 to 600° C., 374 to 550° C., 380 to 550° C., 390 to 550° C., 400 to 550° C., 425 to 550° C., 450 to 550° C., 460 to 550° C., 475 to 550° C., 500 to 550° C., 374 to 500° C., 380 to 500° C., 390 to 500° C., 400 to 500° C., 425 to 500° C., 450 to 500° C., 460 to 500° C., 475 to 500° C., 374 to 475° C., 380 to 475° C., 390 to 475° C., 400 to 475° C., 425 to 475° C., 450 to 475° C., 460 to 475° C., 374 to 460° C., 380 to 460° C., 390 to 460° C., 400 to 460° C., 425 to 460° C., 450 to 460° C., 374 to 450° C., 380 to 450° C., 390 to 450° C., 400 to 450° C., 425 to 450° C., 374 to 425° C., 380 to 425° C., 390 to 425° C., 400 to 425° C., 374 to 400° C., 380 to 400° C., 390 to 400° C., 374 to 390° C., 380 to 390° C., or 374 to 380° C.

In one or more embodiments, the supercritical water unit 400 may be operated at a pressure of greater than or equal to 21 MPa. In one or more embodiments, the supercritical water unit 400 may be operated at a pressure of from 21 to 35 MPa, 22 to 35 MPa, 23 to 35 MPa, 25 to 35 MPa, 30 to 35 MPa, 21 to 30 MPa, 22 to 30 MPa, 23 to 30 MPa, 25 to 30 MPa, 21 to 25 MPa, 22 to 25 MPa, or 23 to 25 MPa.

In one or more embodiments, cracking, dealkylation, isomerization, alkylation, condensation, ring opening, cyclization, dehydrogenation, hydrogenation, and dimerization reactions may occur in the supercritical water unit 400.

In various embodiments, the treated product 440 may pass through a cooler 432. In one or more embodiments, the cooler 432 may cool the treated product 440 to a temperature of greater than or equal to 50° C. and less than or equal to 350° C. In one or more embodiments, the cooler 432 may cool the treated product 440 to a temperature between 50 to 350° C., 100 to 350° C., 150 to 350° C., 200 to 350° C., 250 to 350° C., 300 to 350° C., 50 to 300° C., 100 to 300° C., 150 to 300° C., 200 to 300° C., 250 to 300° C., 50 to 250° C., 100 to 250° C., 150 to 250° C., 200 to 250° C., 50 to 200° C., 100 to 200° C., 150 to 200° C., 50 to 150° C., 100 to 150° C., or 50 to 100° C.

In one or more embodiments, the treated product 440 may pass through a depressurizer 448. In some embodiments, the depressurizer 448 may be a let down valve, a back pressure regulator, a pressure control valve, a series of capillary-type tubes, other similar devices, or combinations thereof. In one or more embodiments, the depressurizer 448 may depressurize the treated product 440 to a pressure of greater than or equal to 0.1 MPa and less than or equal to 1 MPa. In one or more embodiments, the depressurizer 448 may depressurize the first upgraded output to a pressure between 0.1 to 1 MPa, 0.2 to 1 MPa, 0.5 to 1 MPa, or any combination thereof. In one or more embodiments, the treated product 440 may pass through both a cooler 432 and a depressurizer 448.

As noted herein above, the treated product 440 may be separated to obtain a purified product 575 and a concentrated product 550. In some embodiments, separating the treated product 440 may include passing the treated product 440 to the separation unit 500. In one or more embodiments, the separation unit 500 may be an extraction device, a fractionation device, or a filtration device to obtain a purified product 575 and a concentrated product 550. In some embodiments, at least a portion of the purified product may be recycled back to the hydrocracking unit 200. In some embodiments, all of the purified product may be recycled back to the hydrocracking unit 200.

Without being bound by theory, heavy polynuclear aromatics are believed to form sheet-like materials because the heavy polynuclear aromatics are planar in structure. Strong van der Waals interaction between heavy polynuclear aromatic sheets may form suspended or precipitated particles in the treated product 440 that can be separated out using filtration, fractionation, or extraction.

In various embodiments, filtration may include using a filtration device that includes a single filtering element or multiple filtering elements. In some embodiments, extraction may include using an extraction solvent. The extraction solvent may be selected from $C_3$ to $C_8$ paraffins, such as n-pentane and n-heptane. The heavy polynuclear aromatics have poor solubility in $C_3$ to $C_8$ paraffins, and thus can be separated from other components in the treated product.

In some embodiments, separating the treated product 440 to obtain the purified product 575 and the concentrated product 550 may include separating the treated product in a gas-liquid separator to obtain a gas product and a liquid product. In various embodiments, the process may further include separating the liquid product in an oil-water separator to obtain a water product and an oil product. In one or more embodiments, the oil-water separator may be a gravity-assisted oil-water separator, a coalescing-assisted oil-water separator, a centrifuge-type oil-water separator, or other similar oil-water separator. In one or more embodiments, the process further includes passing the oil product to an extraction device, a fractionation device, or a filtration device to separate the oil product to obtain a purified product and a concentrated product.

In various embodiments, the gas product may include $H_2$, $H_2O$, CO, $CO_2$, $H_2S$, $NH_3$, $C_1$ hydrocarbons, $C_2$ hydrocarbons, $C_3$ hydrocarbons, $C_4$ hydrocarbons, $C_5$ hydrocarbons, $C_6$ hydrocarbons, or combinations thereof. In one or more embodiments, the gas product may comprise 0 to 5% $H_2$, 0 to 10% $H_2O$, 0 to 5% CO, 0 to 5% $CO_2$, 0 to 25% $H_2S$, 0 to 25% $NH_3$, 0 to 25% $C_1$ hydrocarbons, 0 to 50% $C_2$ hydrocarbons, 0 to 50% $C_3$ hydrocarbons, 0 to 60% $C_4$ hydrocarbons, 0 to 25% $C_5$ hydrocarbons, and 0 to 5% $C_6$ hydrocarbons.

In some embodiments, the purified product 575 may include less than 300 ppmw, less than 250 ppmw, less than 200 ppmw, less than 150 ppmw, less than 100 ppmw, less than 75 ppmw, less than 50 ppmw, or less than 35 ppmw heavy polynuclear aromatics, such as from 0 to 300ppmw, from 0 to 250 ppmw, from 0 to 200 ppmw, from 0 to 150 ppmw, from 0 to 100 ppmw, from 0 to 75 ppmw, from 0 to 50 ppmw, or from 0 to 35 ppmw heavy polynuclear aromatics.

In some embodiments, the process may further include using the heavy polynuclear aromatics to form pitch. In one or more embodiments, the pitch is isotropic pitch. In one or more embodiments, the pitch is mesophase pitch. Pitch is generally prepared by polymerization of tar from wood, coal, and/or petroleum-based heavy resides such as petroleum residue such as vacuum tower bottom, FCC decant oil, and pyrolysis fuel oil from steam cracking processes. Pitch is in solid form at ambient conditions. Petroleum-based pitch is produced by heat treatment and distillation of highly aromatic and heavy fractions of crude oil, refinery streams, and steam cracker product such as pyrolysis fuel oil. Pitch is a complex mixture of dominant aromatic and alkylated aromatic compounds.

Pitch can be classified into two categories per its optical and crystallographic characters. Isotropic pitch and mesophase pitch. Petroleum-based pitch, unless it undergoes further treatment, is typically in the form of isotropic pitch which can be used to produce final carbon product (such as carbon fiber) having relatively low crystallinity. By heat treating isotropic pitch at temperature of from 300 to 500° C., mesophase pitch, which has an optical anisotropic nature is formed. Mesophase pitch has a liquid crystalline nature and a short range orientational order of aromatic sheets. Mesophase pitch is a precursor to activated carbon fiber and other high-end carbon materials having high crystallinity.

The primary reactions necessary to form mesophase pitch are dehydrogenative polymerization and cleavage of aliphatic substitutes on the aromatic core. While the heavy polynuclear aromatics undergo processing in supercritical water unit, the treatment with supercritical water may cleave the side chains of any alkylated aromatics, thus leading to heavy polynuclear aromatics that may require less processing to form mesophase pitch. Additionally, pitch having higher carbon/hydrogen ratio and minimum amount of heteroatoms is preferred. Processing in the supercritical water unit may help to remove heteroatoms such as sulfur, nitrogen, and metals.

In some embodiments, the pitch is prepared according to J. Mater. Sci, 21 (20), 1986, 424-428, the entirety of which is hereby incorporated by reference.

EXAMPLES

The various embodiments of processes and systems for upgrading crude oil will be further clarified by the following examples. The examples are illustrative in nature, and should not be understood to limit the subject matter of the present disclosure.

Comparative Example

A computer simulation using Aspen-HYSYS was used to generate the following results.

Figure 3:
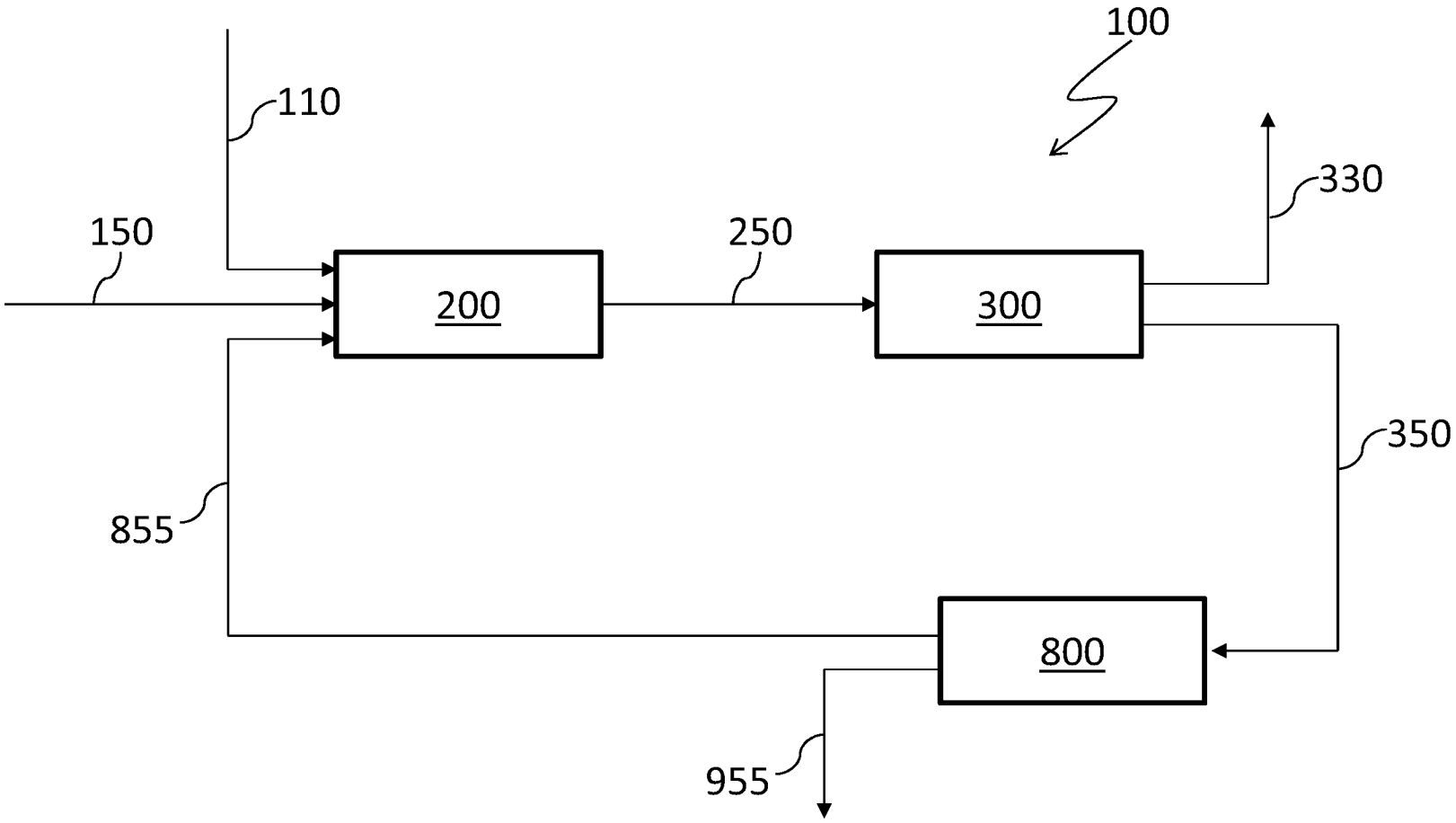
FIG. 3 illustrates a schematic view of a comparative process for upgrading a hydrocarbon feedstock.

A hydrocracking unit, fractionation unit, and vacuum distillation unit were set up as shown in FIG. 3. A fresh vacuum gas oil, having the properties shown in Table 1, was used.

TABLE 1

| Properties of the Vacuum Gas Oil | |
|---|---|
| Properties | Fresh Feed |
| API* Gravity [degree] | 19.9 |
| TBP 0% [C.] | 319 |
| TBP 5% [C.] | 360 |
| TBP 10% [C.] | 386 |
| TBP 30% [C.] | 438 |
| TBP 50% [C.] | 473 |
| TBP 70% [C.] | 509 |
| TBP 90% [C.] | 557 |
| TBP 95% [C.] | 576 |
| TBP 100% [C.] | 605 |
| Sulfur Wt Pct [%] | 2.64 |
| Nitrogen Content [ppmwt] | 946.31 |
| Conradson Carbon Content [%] | 1.06 |
| Kinematic Viscosity @ 50° C. | 92.87 |
| Paraffins by Volume [%] | 17.52 |
| Olefins by Volume [%] | 0.00 |
| Naphthenes by Volume [%] | 22.28 |
| Aromatics by Volume [%] | 60.19 |

*API refers to the American Petroleum Institute.

Referring now to FIG. 3, the fresh vacuum gas oil, used as hydrocarbon feedstock 150, at a rate of 5246 metric tonnes per day (MTD) and 35365 barrels per day (BPD), recycled vacuum gas oil 855 at a rate of 1404 MTD and 9630 BPD, and hydrogen gas 110 at a rate of 213 MTD were introduced into the hydrocracking unit 200. The hydrocracking unit 200 was operated at 68 vol % conversion, wherein the vol % conversion was defined as the product distillate amount divided by the total hydrocracker feed amount (fresh vacuum gas oil 150 amount plus unconverted vacuum gas oil 855). The amount of unconverted oil 350 in the fractionated product was about 30 volume percent (vol. %). After hydrocracking, the hydrocracked product 250 was introduced to the fractionation unit 300 to obtain distillates 330 and unconverted oil 350. The distillates 330 included 570 MTD gases, 1744 MTD and 15483 BPD naphtha, 627 MTD and 4891 BPD kerosene, and 1784 MTD and 13630 BPD diesel. The unconverted oil 350 was produced at a rate of 2138 MTD and 14353 BPD. The unconverted oil 350 was passed to a vacuum distillation unit 800 to obtain recycled vacuum oil 855 and a bleed stream 955.

To maintain the HPNA content in the entire hydrocarbon input (i.e. the fresh vacuum gas oil 150 and the recycled vacuum oil 855) to the hydrocracking unit 200, a major portion (34 wt %) of the unconverted oil 350 was disposed through bleeding as a bleed stream 955. The HPNA content of recycled vacuum gas oil 855 was 210 ppmw, which made the entire hydrocarbon input to the hydrocracking unit 200 have an HPNA of 44 ppmw. The bleed stream 955 had an HPNA content of about 7000 ppmw and the HNPA has a concentrated in the bottom fraction/vacuum residue fraction. The bleed stream 955 was discharged at a rate of 735 MTD and 4502 BPD. A summary of the products and their production rates is shown in Table 2.

TABLE 2

| Products and Their Production Rates | | |
|---|---|---|
| Product | Mass Flow Rate(MTD) | Volume Flow Rate(BPD) |
| Gases | 570 | — |
| Naphtha | 1,744 | 15,483 |

TABLE 2-continued

| Products and Their Production Rates | | |
|---|---|---|
| Product | Mass Flow Rate(MTD) | Volume Flow Rate(BPD) |
| Kerosene | 627 | 4,891 |
| Diesel | 1,784 | 13,630 |
| Bleeding | 735 | 4,502 |
| Total | 5,460 | 38,507 |
| Distillates | 4,155 | 34,005 |

Inventive Example

A hydrocracking unit, fractionation unit, supercritical water unit, and separation unit were set up as shown in FIG. 1. A fresh vacuum gas oil have the properties of the fresh vacuum gas oil of the Comparative Example was also used.

Referring now to FIG. 1, the fresh vacuum gas oil, used as hydrocarbon feedstock 150, at a rate of 6505 MTD and 43847 BPD, recycled vacuum gas oil 575 at a rate of 677 MTD and 4490 BPD, and hydrogen gas 110 at a rate of 230 MTD were introduced into the hydrocracking unit 200. After hydrocracking, the hydrocracked product 250 was introduced to the fractionation unit 300 to obtain distillates 330 and unconverted oil 350. The distillates 330 included 521 MTD gases, 1544 MTD and 13707 BPD naphtha, 468 MTD and 3655 BPD kerosene, and 1804 MTD and 13789 BPD diesel. The unconverted oil 350 was produced at a rate of 3075 MTD and 20639 BPD. The unconverted oil 350 was passed to a SCW unit 400 to obtain a treated product. The treated product was then passed to a separation unit 500. The separation unit 500 was a second fractionation unit. The separation unit separated the treated product into 92 MTD gases, 791 MTD and 6581 BPD naphtha, 379 MTD and 2788 BPD kerosene, 1039 MTD and 7467 BPD diesel, 677 MTD and 4490 BPD vacuum gas oil, and 97 MTD and 576 BPD vacuum residue, which included HPNA. The HPNA content of recycled vacuum gas oil 575 was 170 ppmw. Because SCW concentrated HPNA into the vacuum residue fraction, its concentration is lower than comparative example. The entire hydrocarbon input to the hydrocracking unit 200 have an HPNA of 16 ppmw. No vacuum gas oil was bled. The vacuum residue had an HPNA concentration of 8.6 wt %, indicating that the vacuum residue is a good precursor for pitch production. The HPNA was concentrated in the vacuum residue fraction while recycled vacuum gas oil 575 had a lower HPNA concentration due to the condensation reactions that occur in the SCW unit 400. A summary of the products and their production rates is shown in Table 3.

TABLE 3

| Products and Their Production Rates | | |
|---|---|---|
| Product | Mass Flow Rate (MTD) | Volume Flow Rate (BPD) |
| Gases | 613 | — |
| Naphtha | 2,335 | 20,288 |
| Kerosene | 847 | 6,444 |
| Diesel | 2,843 | 21,257 |
| Vacuum Residue | 97 | 576 |
| Total | 6,735 | 48,564 |
| Distillates | 6,026 | 47,988 |

The vacuum residue was subjected to the mesophase pitch preparation procedures of J. Mater. Sci, 21 (20), 1986, 424-428, the entirety of which is hereby incorporated by reference. Yield of the pitch product is about 72 wt. %. The mesophase portion of the resulting pitch was about 82 wt. %.

The total conversion from both the hydrocracking unit 200 and the SCW unit 400 was about 109 vol % conversion, wherein the vol % conversion was defined as the product distillate amount divided by the fresh vacuum gas oil 150 amount, by recycling unconverted vacuum gas oil 575. However, similar to the Comparative Example, the amount of unconverted oil 350 in the fractionated product was about 40 volume percent (vol. %). The UCO 350 fraction can be maintained higher than the comparative example (30 vol %) because SCW unit 400 can upgrade the UCO 350 and eventually produce distillates.

Having higher levels of unconverted oil production allows higher throughput of the hydrocracking unit 200 (meaning higher LHSV in the hydrocracking unit 200 is acceptable to reach the target distillate production). In the Inventive Example, the throughput of the hydrocracking unit 200 was 48,337 BPD which is 7.4% higher than that of Comparative Example. Because the SCW unit 400 converts substantial amounts of UCO into distillates, the recycled vacuum gas oil amount was much smaller than that of the Comparative Example (4490 BPD vs 9630 BPD), which allows higher throughput of fresh vacuum gas oil (43847 BPD vs 35365 BPD, 24% higher). Such increased capacity of the hydrocracking unit 200 gives huge economic benefits. Additionally, the lower HPNA content in the hydrocarbon feedstock (16 ppmw vs 44 ppmw) extends the catalyst life.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B and C should be interpreted as also disclosing a composition "consisting of" components A, B, and C as well as a composition "consisting essentially of" components A, B, and C.

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

The present disclosure includes numerous aspects, referred to as Aspects 1-20, as described hereinbelow.

Aspect 1. A process for upgrading a hydrocarbon feedstock, the process comprising: introducing a hydrocarbon feedstock into a hydrocracking unit to obtain a hydrocracked product; introducing the hydrocracked product to a fractionation unit to obtain distillates and unconverted oil, the unconverted oil having a boiling point greater than 375° C.; introducing the unconverted oil and supercritical water to a supercritical water unit to obtain a treated product, wherein the supercritical water has a pressure greater than 21 MPa and a temperature above 374° C.; and separating the treated product to obtain purified product and a concentrated product, the concentrated product comprising heavy polynuclear aromatics (HPNA).

Aspect 2. The process of aspect 1, wherein the unconverted oil has a residence time within the supercritical water unit of from 10 seconds to 60 minutes within the supercritical reactor.

Aspect 3. The process of aspect 1 or aspect 2, further comprising recycling at least a portion of the purified product to the hydrocracking unit.

Aspect 4. The process of any one of aspects 1-3, further comprising mixing the unconverted oil and the supercritical water before introducing the unconverted oil and the supercritical water to the supercritical water unit.

Aspect 5. The process of any one of aspects 1-4, wherein the feedstock is vacuum gas oil.

Aspect 6. The process of any one of aspects 1-5, wherein the feedstock comprises less than or equal to 800 ppmw heavy polynuclear aromatics.

Aspect 7. The process of any one of aspects 1-6, wherein a ratio of a flow rate of the supercritical water to a flow rate of the unconverted oil is from 20:1 to 1:1 when the unconverted oil and the supercritical water are introduced to the supercritical water unit.

Aspect 8. The process of any one of aspects 1-7, wherein the supercritical water is demineralized water comprising: a conductivity of less than 1 μS/cm; a sodium content of less than 5 μg/L; a chloride content of less than 5 μg/L; and a silica content of less than 3 μg/L.

Aspect 9. The process of any one of aspects 1-8, wherein the supercritical water unit operates at a pressure greater than 21 MPa and a temperature of from 374° C. to 600° C.

Aspect 10. The process of any one of aspects 1-9, wherein the supercritical water has a pressure greater than 21 MPa and a temperature of from 400° C. to 700° C. before the supercritical water is introduced into the supercritical water unit.

Aspect 11. The process of any one of aspects 1-10, wherein the unconverted oil has a pressure greater than 21 MPa and a temperature of from 50° C. to 350° C. before the supercritical water is introduced into the supercritical water unit.

Aspect 12. The process of any one of aspects 1-11, wherein fluid in the supercritical water unit is in a turbulent flow regime with a Reynolds number greater than 3,000.

Aspect 13. The process of any one of aspects 1-12, wherein the hydrocracking unit operates at a pressure of from 5 to 25 MPa, a temperature of from 300° C. to 600° C., and the feedstock has a liquid hourly space velocity of from 0.05 to 3 $hr^{-1}$.

Aspect 14. The process of any one of aspects 1-13, wherein the hydrocarbon feedstock is vacuum gas oil (VGO).

Aspect 15. The process of any one of aspects 1-14, wherein the hydrocracked product comprises from 0 to 50 wt. % unconverted oil.

Aspect 16. The process of any one of aspects 1-15, wherein separating the treated product to obtain the purified product and the concentrated product comprises passing the treated product to an extraction device, a fractionation device, or a filtration device to obtain the purified product and the concentrated product.

Aspect 17. The process of any one of aspects 1-16, wherein separating the treated product to obtain the purified product and the concentrated product comprises: separating the treated product in a gas-liquid separator to obtain a gas product and a liquid product; separating the liquid product in an oil-water separator to obtain a water product and an oil product; and passing the oil product to an extraction device, a fractionation device, or a filtration device to separate the oil product to obtain the purified product and the concentrated product.

Aspect 18. The process of any one of aspects 1-17, wherein the purified product comprises from 0 to 35 ppmw heavy polynuclear aromatics.

Aspect 19. The process of any one of aspects 1-18, further comprising using the heavy polynuclear aromatics to form pitch.

Aspect 20. The process of aspect 19, wherein the pitch is mesophase pitch.

The invention claimed is:

1. A process for upgrading a hydrocarbon feedstock, the process comprising:

introducing a hydrocarbon feedstock into a hydrocracking unit to obtain a hydrocracked product;

introducing the hydrocracked product to a fractionation unit to obtain distillates and unconverted oil, the unconverted oil having a boiling point greater than 375° C.;

introducing the unconverted oil and supercritical water to a supercritical water unit to obtain a treated product, wherein the supercritical water has a pressure greater than 21 MPa and a temperature above 374° C. and a ratio of a flow rate of the supercritical water to a flow rate of the unconverted oil is from 20:1 to greater than 10:1 when the unconverted oil and the supercritical water are introduced to the supercritical water unit; and separating the treated product to obtain purified product and a concentrated product, wherein the concentrated product comprises heavy polynuclear aromatics (HPNA).

2. The process of claim 1, wherein the unconverted oil has a residence time within the supercritical water unit of from 10 seconds to 60 minutes within the supercritical reactor.

3. The process of claim 1, further comprising recycling at least a portion of the purified product to the hydrocracking unit.

4. The process of claim 1, further comprising mixing the unconverted oil and the supercritical water before introducing the unconverted oil and the supercritical water to the supercritical water unit.

5. The process of claim 1, wherein the feedstock comprises less than or equal to 800 ppmw heavy polynuclear aromatics.

6. The process of claim 1, wherein the supercritical water is demineralized water comprising:

a conductivity of less than 1 μS/cm;

a sodium content of less than 5 μg/L;

a chloride content of less than 5 μg/L; and a silica content of less than 3 μg/L.

7. The process of claim 1, wherein the supercritical water unit operates at a pressure greater than 21 MPa and a temperature of from 374° C. to 600° C.

8. The process of claim 1, wherein the supercritical water has a pressure greater than 21 MPa and a temperature of from 400° C. to 700° C. before the supercritical water is introduced into the supercritical water unit.

9. The process of claim 1, wherein the unconverted oil has a pressure greater than 21 MPa and a temperature of from 50° C. to 350° C. before the supercritical water is introduced into the supercritical water unit.

10. The process of claim 1, wherein fluid in the supercritical water unit is in a turbulent flow regime with a Reynolds number greater than 3,000.

11. The process of claim 1, wherein the hydrocracking unit operates at a pressure of from 5 to 25 MPa, a temperature of from 300° C. to 600° C., and the feedstock has a liquid hourly space velocity of from 0.05 to 3 $hr^{-1}$.

12. The process of claim 1, wherein the hydrocarbon feedstock is vacuum gas oil (VGO).

13. The process of claim 1, wherein the hydrocracked product comprises from 0 to 50 wt. % unconverted oil.

14. The process of claim 1, wherein separating the treated product to obtain the purified product and the concentrated product comprises passing the treated product to an extraction device, a fractionation device, or a filtration device to obtain the purified product and the concentrated product.

15. The process of claim 1, wherein separating the treated product to obtain the purified product and the concentrated product comprises:

separating the treated product in a gas-liquid separator to obtain a gas product and a liquid product;

separating the liquid product in an oil-water separator to obtain a water product and an oil product; and passing the oil product to an extraction device, a fractionation device, or a filtration device to separate the oil product to obtain the purified product and the concentrated product.

16. The process of claim 1, wherein the purified product comprises from 0 to 35 ppmw heavy polynuclear aromatics.

17. The process of claim 1, further comprising using the heavy polynuclear aromatics to form pitch.

18. The process of claim 17, wherein the pitch is mesophase pitch.

* * * * *